United States Patent [19]

Roberts

[11] Patent Number: 4,844,644

[45] Date of Patent: Jul. 4, 1989

[54] CALENDAR PAD STAND

[76] Inventor: Raymond P. Roberts, P.O. Box 1117, Tulsa, Okla. 74101

[21] Appl. No.: 142,944

[22] Filed: Jan. 12, 1988

Related U.S. Application Data

[62] Division of Ser. No. 803,813, Dec. 2, 1985.

[51] Int. Cl.[4] ..... B42F 13/40

[52] U.S. Cl. ..... 402/70; 40/120

[58] Field of Search ..... 40/120; 402/70, 71, 402/72, 73

[56] References Cited

U.S. PATENT DOCUMENTS

| | | | |
|---|---|---|---|
| 1,129,206 | 2/1915 | Jones | 402/73 |
| 2,614,566 | 10/1952 | McConnaughy | 402/70 |
| 3,383,786 | 5/1968 | McIntosh | 402/70 X |

FOREIGN PATENT DOCUMENTS

| | | | |
|---|---|---|---|
| 730664 | 1/1943 | Fed. Rep. of Germany | 40/120 |
| 695063 | 11/1930 | France | 40/120 |

*Primary Examiner*—Paul A. Bell

*Attorney, Agent, or Firm*—Head & Johnson

[57] ABSTRACT

An inclined work surface comprised of a work surface and a support for inclininglyy supporting the work surface from a desk, table, or other horizontal resting surface. The inclined work surface includes a storage compartment within the support and the work surface is hinged to the support above the storage compartment. The inclined work surface is at least as wide as the knee-hole on an office-type desk and has an angle of inclination between about 2 degrees and about 10 degrees. The inclined work surface also includes a calendar apparatus which rests within the support and is accessible through an opening in the work surface. The calendar apparatus includes an adjusting assembly for adjusting the height of the calendar pages.

8 Claims, 5 Drawing Sheets

CALENDAR PAD STAND

This is a divisional of co-pending application Ser. No. 803,813 filed on Dec. 2, 1985.

BACKGROUND OF THE INVENTION

The present invention generally relates to inclined work surfaces for desk tops and, more particularly, is concerned with an inclined work surface which may be used on desks, is unobtrusive and aesthetically pleasing in appearance, provides storage facilities, and may include a calendar apparatus having means for adjusting the height of the calendar pages.

The use of an inclined surface on a desk top is a known and used aid to reading and writing activities. Portable and stationary desks and lecterns are known which incorporate this feature, and which include storage compartments beneath the inclined work surface.

U.S. Pat. No. 4,244,632 to Molinari discloses a calligrapher's portable desk having a sloped top and compartment's beneath the sloped top. U.S. Pat. No. 119,316 to Carter and Emery disclosed an inclined writing surface with a storage compartment beneath it on a desk.

The prior patents do not disclose an inclined work surface for desk tops which is at least as wide as the knee hole on an office-type desk, which is restricted to dimensions which render it unobtrusive and aesthetically pleasing in appearance while providing storage compartments beneath the work surface, and which may include a calendar apparatus having means for adjusting the height of the calendar pages relative to the inclined work surface.

SUMMARY OF THE INVENTION

It is an object of the present invention to provide a work surface to be used on desks, tables, or other resting surfaces which is aesthetically pleasing; will hold books, documents, and papers at a comfortable angle for writing and reading, particularly reading with bifocal eye glasses; which is large enough to comfortably facilitate desk-type work activities; and which has storage facilities for concealing the working documents which are normally found on an office type-desk work surface.

Specifically, the inclined work surface of the present invention comprises a work surface and support means for incliningly supporting the work surface from a resting surface. The support means comprises a storage compartment within the support means and hinging means for hinging one edge of the work surface to the support means. The hinging means allows the work surface to be placed in an open or a closed position on the support means above the storage compartment. The inclined work surface is at least as wide as the knee-hole on an office type desk and the angle of inclination of the inclined work surface is between about 2 degrees and about 10 degrees.

The inclined work surface may also include a calendar apparatus. The calendar apparatus rests within the storage compartment and is accessible through an opening in the work surface. The calendar apparatus includes adjusting means for adjusting the height of the calendar pages relative to the work surface and to the calendar apparatus.

DESCRIPTION OF THE PREFERRED EMBODIMENTS

Before explaining the present invention in detail, it is to be understood that the invention is not limited to the details of construction and arrangement of parts illustrated in the accompanying drawings, since the invention is capable of other embodiments and of being practiced or carried out in various ways commensurate with the claims herein. Also, it is to be understood that the phraseology or terminology employed herein is for the purpose of description and not of limitation.

Figure 1:
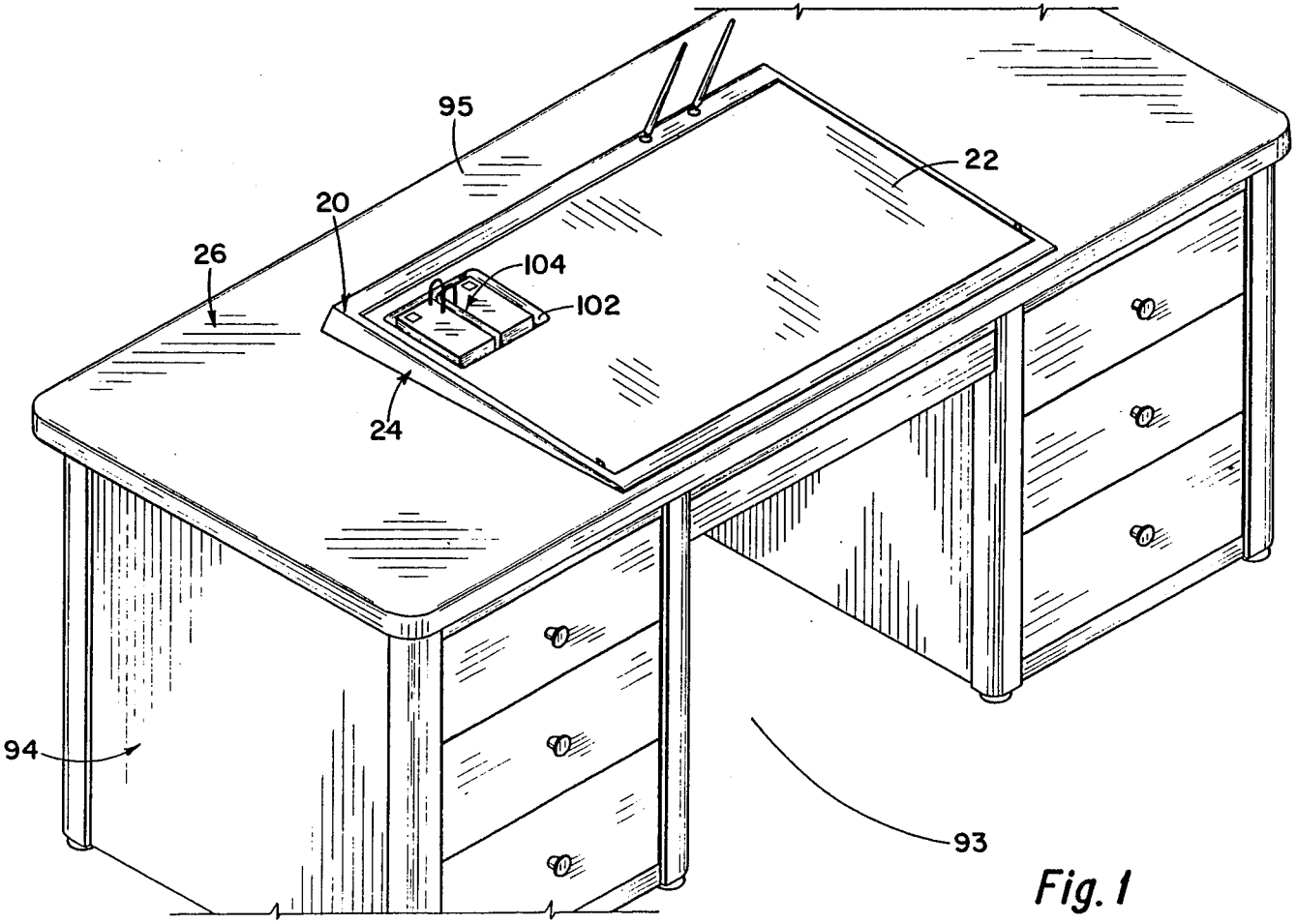
FIG. 1 is a perspective view of an embodiment of the inclined work surface and calendar apparatus of the present invention, situated on an office desk.

Referring now to the drawings, and more particularly to FIG. 1, there is shown an inclined work surface, generally designated by the reference numeral 20, for use with desks, tables, and other resting surfaces which is an example embodiment of the present invention. The invention basically comprises a work surface 22 and support means 24 for incliningly supporting the work surface from a resting surface 26.

Figure 5:
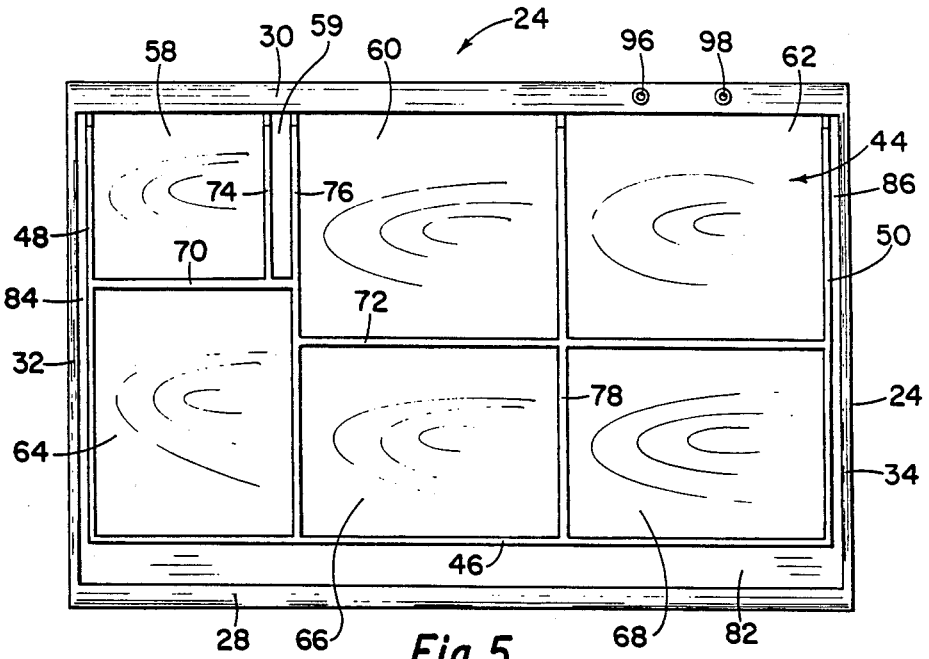
FIG. 5 is a view along line 5—5 of FIG. 4.
Figure 4:
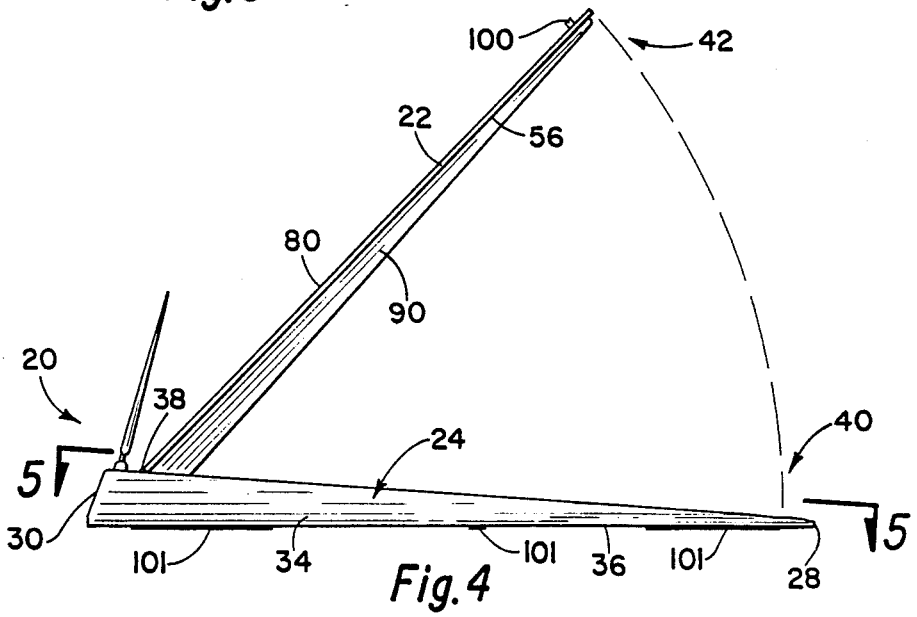
FIG. 4 is a side view of the inclined work surface.

In a preferred embodiment of the work surface 20, as further illustrated in FIGS. 4 and 5, the support means 24, is further comprised of a front edge 28 and back edge 30, the back edge being taller than the front edge; a left side edge 32 and a right side edge 34, the height of the side edges inclining generally upward from the front edge 28 to the back edge 30; and a base 36. In the example embodiment the work surface 22 is of rectangular shape and the support means 24 is of rectangular shape. The front edge 28 of the support means 24 is parallel to the back edge 30, and the left side edge 32 is parallel to the right side edge 34.

Figure 3:
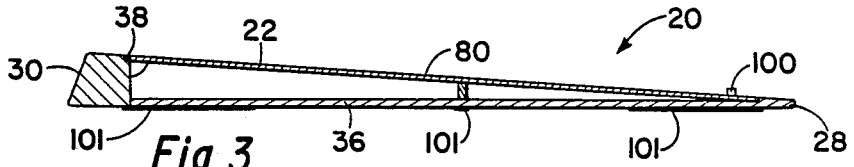
FIG. 3 is a cross-sectional view of the inclined work surface along line 3—3 of FIG. 2.

In the example embodiment, as illustrated in FIGS. 3 and 4, the support means 24 further comprises hinging means 38 for hinging one edge of the work surface 22 to the back edge of the support means 24 about an axis generally parallel to the front edge 28 of the support means. The hinging means 38 provides a closed position, generally designated by reference number 40, of the work surface 22 in which the work surface 22 is resting on the support means 24 and an open position, generally designated by the refernce number 42, of the work surface in which the work surface 22 is lifted and rotated about the hinging means 38 away from the front edge 28 of the support means 24. In the illustrated, example embodiment, the hinging means 38 is a piano-hinge, although any type hinging may be used. The instant support means includes a storage compartment, generally designated 44, within the support means beneath the work surface 22.

In the example embodiment, referring to FIG. 5, the storage compartment 44 comprises a front wall 46, a left side wall 48 and a right side wall 50. The left and right side walls 48 and 50 should vary in height from the front wall to near the back edge 30 of the support means 24 such that the top of the left side wall 48 and the top of the right side wall 50 are in continuous, supporting contact with the bottom face 56 of the work surface 22 in the closed position 40.

As illustrated in FIG. 5, the storage compartment 44 may further comprise a plurality of storage spaces 58, 59, 60, 62, 64, 66, and 68 separated by a plurality of partitions 70, 72, 74, 76 and 78. The height of the partitions should vary such that the tops of the partitions are in continuous, supporting contact with the bottom face 56 of the work surface 22 when the work surface is in the closed position 40. In the example embodiment the heights of the partitions 70, 72, 74, 76 and 78, left side wall 48, right side wall 50, and front wall 46 of the storage compartment 44 are such that the top face 80 of the work surface 22 in the closed position 40 is flush with the tops of the front edge 28, back edge 30, left side edge 32, and right side edge 34 of the support means 24.

Referring to FIG. 5, in the example embodiment the storage compartment 44 is rectangular, the front wall 46 of the storage compartment being parallel to the back edge 30 of the support means 24 and the left side wall 48 of the storage compartment 44 being parallel to the right side wall 50. In this embodiment, the front wall 46 creates a front recess 82 between the front wall and the front edge 28 of the support means 24, the left side wall 48 creates a left recess 84 between the left side wall and the left side edge 32 of the support means 24, and the right side wall 50 creates a right recess 86 between the right side wall and the right side edge 34 of the support means 24.

Figure 2:
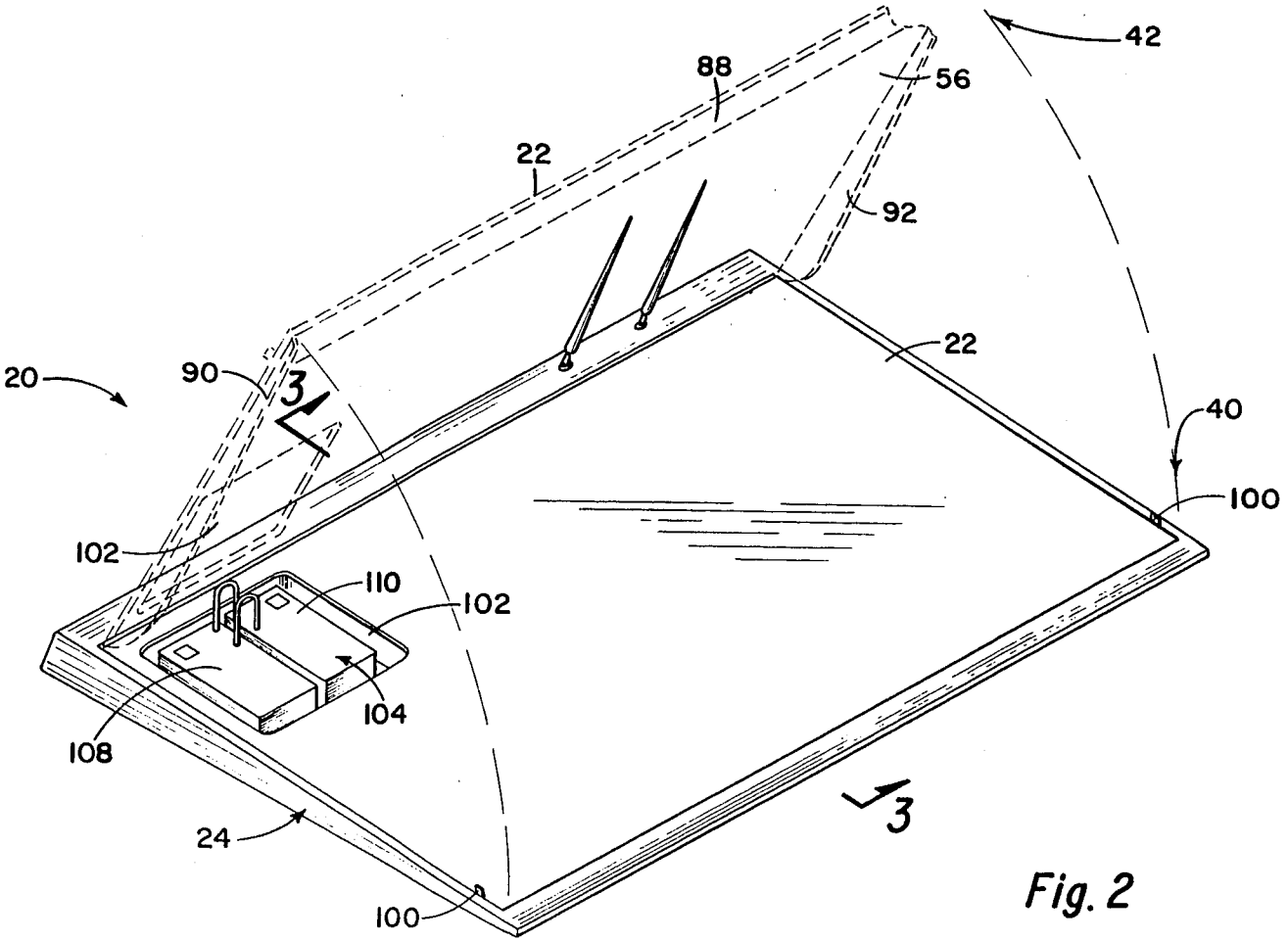
FIG. 2 is a perspective view of an embodiment of the inclined work surface and calendar apparatus of the present invention.

Also, in this embodiment, illustrated in phantom in FIG. 2, the bottom face 56 of the work surface 22 comprises a front edge support 88, a left edge support 90, and a right edge support 92. The front edge support 88 should fit into the front recess 82 of the support means 24 in the closed position 40 of the work surface 22. The height of the front edge support 88 should vary such that the front edge support rests flush on the base 36 of the support means 24 in the closed position 40 of the work surface 22. The left edge support 90 should fit into the left recess 84 and the right edge support 92 should fit into the right recess 86 of the support means 24 in the closed position of the work surface 22. The left and right edge supports 90 and 92 should vary in height from the front edge support 88 to near the back edge 30 of the support means 24 such that the left and right side supports 90 and 92 will rest flush on the base 36 of the support means 24 in the closed position 40 of the work surface 22.

The present invention may be of particular utility on an office-type desk for use as a surface to facilitate office-type work activities, such as reading and writing, as well as storing papers, folders, books, scissors, letter openers, etc. The nature of these activities dictates that the angle of inclination between the work surface 22 and the base 36 of the support means 24 or a horizontal plane of the resting surface 26 be within a range of about 2 degrees to about 10 degrees to provide the advantages of the invention over a horizontal work surface, i.e., the more comfortable positioning of papers and books for reading and writng while at the same time limiting the angle of inclination so that the tendency of objects placed on the inclined work surface 22 to slide down the work surface will be inhibited. To enhance the ability of the work surface 22 as a writing surface and to retain documents and objects in place on the work surface and minimize the tendency of objects to slide down the work surface, in the example embodiment the work surface 22 is covered with a smooth covering having a relatively high coefficient of friction, such as leather or vinyl.

The work surface 22 may be sized to fit easily and aesthetically on any resting surface 26, and should provide sufficient area for a writing pad, books, and documents while keeping these objects within easy reach. Preferably, the width of the work surface 22, measured as the distance from the left side edge 32 to the right side edge 34 of the support means, should be between about 24 inches and about 60 inches and should be at least as wide as the knee-hole 93 on an office-type desk 94 to provide a comfortable work area, as illustrated in FIG. 1. The depth of the device 20, measured as the transverse distance from the front edge 28 to the back edge 30 of the support means 24 is preferably between 18 inches and 36 inches. The height of the device 20, measured as the height of the back edge 30 of the support means 24, is preferably between about 1 inch and about 4 inches. The inclined work surface 20 will normally occupy a portion of a desk top 95 or resting surface 26 as illustrated in FIG. 1, i.e., its normal function will be to provide an inclined work area, not an entire desk or table top, as illustrated in FIG. 1.

An important consideration in the size and design of the inclined work surface 20 is the overall appearance or aesthetic appeal, particularly when the device 20 is used in a formal environment, such as with an executive office desk. The example embodiment was sized to balance and optimize the size and aesthetic considerations. In the example embodiment, the height of the back edge 30 is about 1.75 inches to provide sufficient room for a 1 inch thick folder in the storage compartment 44, and to prevent the device 20 from appearing too high or bulky on a desk. In the example embodiment the width, or distance from the left side edge 32 to the right side edge 34 of the support means, is about 36 inches; and the depth, or transverse distance from the front edge 26 to the back edge 28 of the support means is about 24 inches. As illustrated in FIG. 5, these dimensions were selected to give room for at least five rectangular storage spaces 60, 62, 64, 66, and 68 in the storage compartment which are at least letter paper size, one calendar storage space 58, and one storage space 59 for a library set, i.e., scissors and letter opener, and to allow for a back edge 30 height of about 1.75 inches while giving the work surface an angle of inclination of about 5 degrees between the work surface 22 and the base 36 of the support means 24 or a horizontal plane of the resting surface 26, best illustrated in FIG. 3 or 4.

It is preferred that the angle of inclination be between about 2 degrees and about 7 degrees, with about 5 degrees being the angle of inclination of the example embodiment, to give a comfortable writing surface angle and to provide a comfortable surface reading angle for a person wearing bi-focal glasses.

The example embodiment of the inclined work surface 20 is made of high quality wood, although polymer, metal, or equivalent materials could also be used.

The top side of the back edge 30 of the support means 24 may be provided with recesses 96 and 98 for receiving and retaining pens and pencils. There are two recesses illustrated in FIG. 5, although any number may be provided. The recesses 96 and 98 should be conically shaped at the bottom with a small cavity extending downward from the apex of the cone. The recesses 96 and 98 are shaped and designed to receive the sockets which hold the pen and pencil of a typical desk set. The recesses 96 and 98 may be lined with a metal, polymer, or equivalent sleeve to protect the back edge 30 of the support means 24 from wear and tear.

The work surface 22 of the example embodiment, of referring to FIG. 4, comprises a grasping means 100 for grasping the work surface with a human hand in order to open or close the work surface. In FIG. 3 the grasping means 100 is a tab of the material covering the work surface, although the grasping means may take other embodiments. For example, recesses may be cut into the front edge 28, left side edge 32, or right side edge 34 of the support means adjacent to the edge of the work surface which would allow the insertion of a finger beneath the work surface 22 to lift or lower the work surface.

The bottom side of the planar base 36 of the support means 24 may be provided with cork, rubber, cloth, or equivalent surfacing 101, as illustrated in FIGS. 3 and 4 to keep the inclined work surface 20 from slipping on its resting surface 26 and to prevent the inclined work surface 20 from damaging its resting surface 26.

An alternative embodiment of the present invention, referring to FIG. 1, is a desk 94 having a top 95 and a knee-hole 93, a portion of the top 95 comprising an inclined work surface 20. The inclined work surface 20 is built into the desk 94 and is at least as wide as the knee hole 93 of the desk but does not cover the entire top surface 95 of the desk. The desk 94 may also comprise retraction means for retracing the inclined work surface 20 into the desk. The retracted work surface would be coplanar with the top of the desk. The retraction means could be an eccentric or equivalent which would support the inclined work surface 20 in both the inclined position and the retracted position.

As illustrated in FIG. 2, the work surface 22 may also include an opening 102 sized to encircle a calendar apparatus 104, such as a desk calendar. The inclined work surface 20 of FIG. 2 includes the calendar apparatus 104 which comprises a calendar base means 106, best seen in FIG. 6, for receiving and retaining the calendar pages 108 and 110 and positioning the calendar pages relative to the work surface 22. The calendar base means 106 rests on the planar base 36 of the support means 24. The calendar apparatus 104 may be an integral part of the support means 24 or an independent, stand-alone device.

Figure 6:
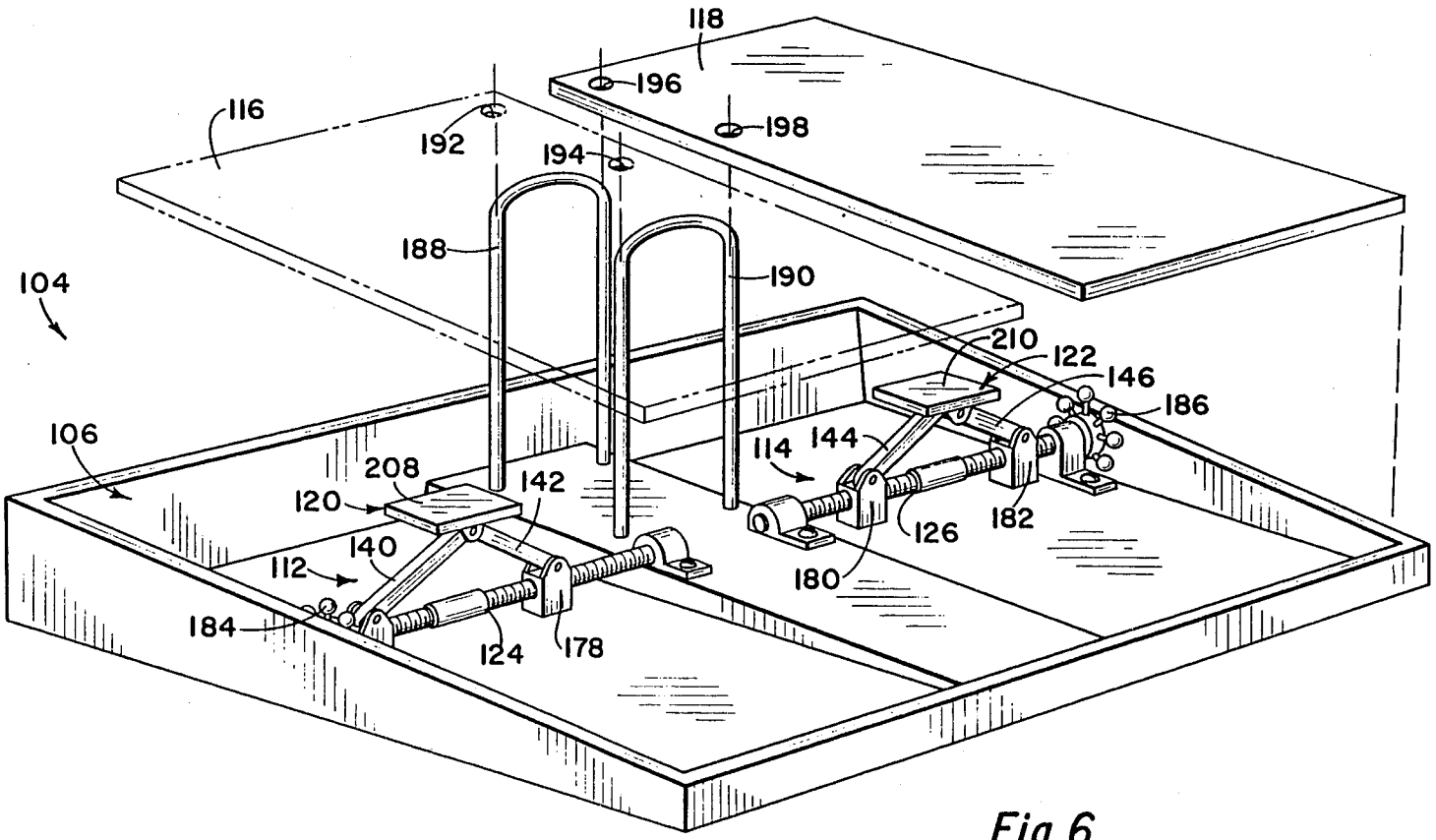
FIG. 6 is a perspective view of an embodiment of the calendar apparatus of the present invention.

As exemplified in FIG. 6, the calendar apparatus 104 comprises adjusting means 112 and 114 for adjusting the height of the calendar pages 108 and 110, illustrated in FIG. 2, relative to the calendar opening 102 in the work surface 22 and to the calendar base means 106. Preferably, there are at least two such adjusting means 112 and 114, at least one adjusting means 112 or 114 being used to adjust the height of the facing pages 108 and 110 on each side of calendar 104. In the example embodiment, each adjusting means 112 and 114 comprises planar means 116 or 118 for supporting the calendar pages 108 or 110 and providing a stable and comfortable writing surface below the calendar pages which may be canted parallel to the work surface 22; and elevator means, generally designated 120 or 122, for varying the height of the planar means 116 or 118.

Figure 7:
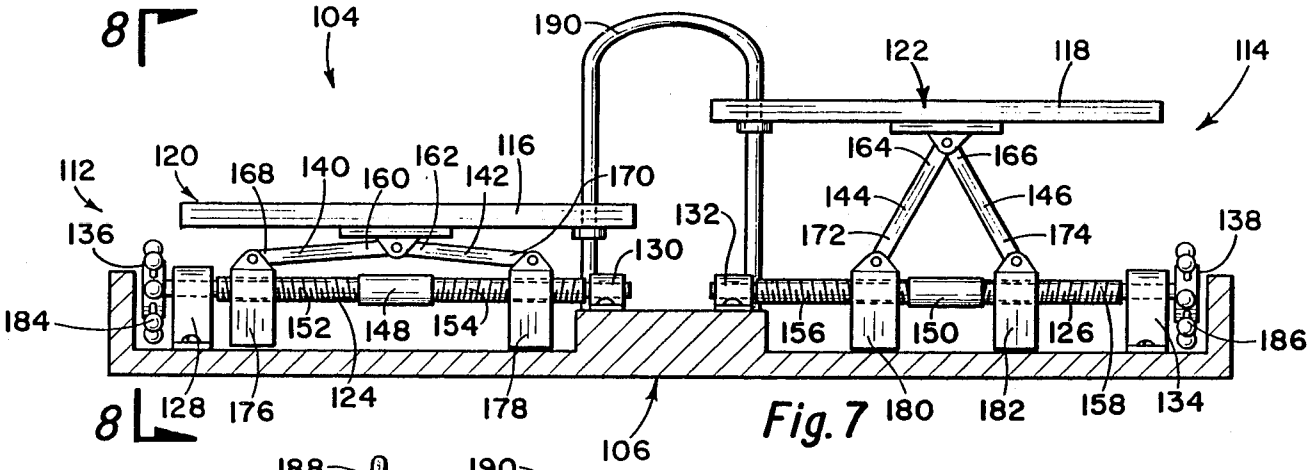
FIG. 7 is a sectional view of the calendar apparatus along line 7—7 of FIG. 8.

Referring to FIG. 7, in the example embodiment, each elevator means 120 or 122 is comprised of a shaft 124 or 126, retaining means 128 and 130 or 132 and 134 for rotatably retaining the ends of the shaft 124 or 126, wheel means 136 or 138 for rotating the shaft, and at least two elongated support arms 140 and 142 or 144 and 146. Each shaft 124 or 126 is mounted transversely to the planar means 116 or 118 and calendar pages 108 or 110 and is threaded from near each end of the shaft to near the midpoint 148 or 150 of the shaft. The threads 152 or 156 at one end of the shaft 124 or 126 are reverse threaded to the threads 154 or 158 at the other end of the shaft. The retaining means 128, 130, 132, or 134 are collars or sleeves made of polymer, metal, wood, or other material compatible with the shaft 124 or 126, and should be slightly larger in diameter than the shaft 124 or 126 to allow the shaft to turn freely in the retaining means.

As stated above, each of elevator means 120 or 122 is comprised of at least two elongated support arms 140 and 142 or 144 and 146. Each arm 140, 142, 144, or 146 has a first end 160, 162, 164, or 166 hingedly connected to the planar means 116 or 118 and a second end 168, 170, 172, or 174 hingedly and threadedly connected to one of the threaded ends of the shaft 124 or 126. The second end 168 or 172 of one arm 140 or 144 is connected to the opposite end of the shaft 124 or 126 from the second end 170 or 174 of the other arm 142 of 146. As exemplified in FIG. 7 each shaft 124 or 26 comprises at least two traveling collars 176 and 178 or 180 and 182 which threadedly engage the shaft threads. Each traveling collar 176, 178, 180, or 182 also hingedly engages the second end 168, 170, 172, or 174 of one of the support arms 140, 142, 144, or 146 and serves to connect the support arms to the shaft 124 and 126. The traveling collars 176, 178, 180, and 182 may be made with a flat bottom surface which extends to near the calendar base means 106, as illustrated in FIG. 7. The flat bottom surface would help to prevent the traveling collars and support arms 140, 142, 144, and 146 from rotating coaxially with the shafts 124 and 126. The hinging at the first and second ends of the support arms 140, 142, 144, and 146 allows the support arms to extend as the traveling collars 176 and 178 or 180 and 182 move along the threads of the shaft 124 or 126 toward the midpoint 148 or 150 of the shaft 124 or 126 and allows the support arms to retract as the traveling collars move along the threads of the shaft toward the outside ends of the shaft.

Figure 8:
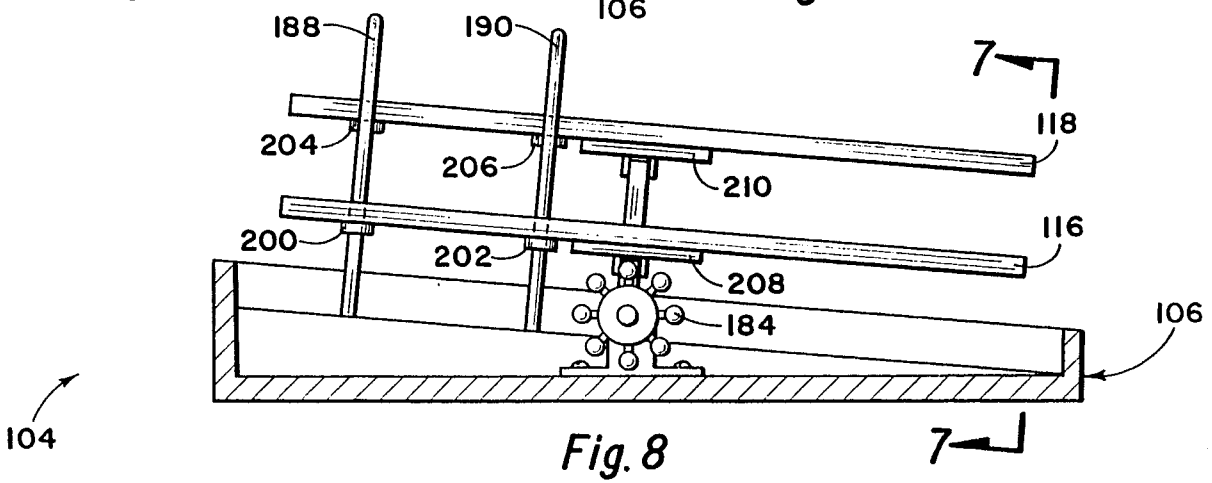
FIG. 8 is a sectional view of the calendar apparatus along line 8—8 of FIG. 7.

As best seen in FIGS. 7 and 8 the wheel means 136 or 138 is preferably located at the end of the shaft 124 or 126 towards the outside of the calendar base means 106, to facilitate access by a human hand, and comprises radially extending tines 184 or 186 to facilitate engagement of the wheel means 136 or 138 with a human finger. The shaft 124 or 126 and wheel means 136 or 138 should be positioned so that the tines 184 and 186 of the wheel means extend slightly above the calendar base means 106 and the wheel means 136 or 138 is located generally between the outside edge of the calendar pages 108 or 110 and the adjacent outside edge of the calendar base means 106.

As illustrated in the example embodiment of FIG. 6 the calendar base means 106 comprises two inverted "U" post harps 188 and 190 for retaining the calendar pages 108 and 110. The harps 188 and 190 are identical to the harps which are universally used on desk calendars and the harps 188 and 190 will receive calendar pages designed to be used with standard two harp desk calendar bases. Each planar means 116 or 118 includes two holes 192 and 194 or 196 and 198 for slidingly engaging the harps 188 and 190 of the calendar base means 106. The peripheries of the holes 192, 194, 196, and 198 may include alignment bushings 200, 202, 204, and 206 to prevent the planar means 116 or 118 from binding on the harps 188 and 190. The alignment bushings 200, 202, 204 and 206 may take the form of cylinders which function to extend the periphery of the holes 192, 194, 196, and 198 below the planar means 116 or 118, as illustrated in FIGS. 7 and 8.

As a further aid in keeping the planar means 116 or 118 from binding on the harps 188 and 190, the planar means 116 and 188 may be independent from the elevator means 120 or 122, as illustrated in FIG. 6. In FIG. 6, mounting plates 208 and 210 are hingedly connected to the support arms 140 and 142 or 144 and 146 and the planar means 116 and 118 rest on the mounting plates 208 and 210. This construction allows the planar means 116 and 118 to slide up and down the harps 188 and 190 without the restriction of a rigid connection to the support arms 140, 142, 144, and 146. Alternatively and/or additionally the holes 192, 194, and 196, and 198 of the planar means 116 and 118 may be made substantially larger than the diameter of the harps 188 and 190 to minimize binding between the planar means and the harps.

The mounting plates 208 and 210 may be canted as illustrated in FIG. 8 in order to cant the planar means 116 and 118 and calendar pages 108 and 110. The harps 188 and 190 may be also mounted on the calendar base means 106 at an angle perpendicular to the cant of the mounting plates 208 and 210 and planar means 116 and 118 to minimize binding between the harps 118 and 190 and the planar means, as best seen in FIG. 8.

The desk calendar apparatus may be made of polymer, wood, metal, or equivalent material with the harps 188 and 190 normally being made of one-eighth inch diameter wire.

The adjusting means 112 and 114 are used to elevate the position of the calendar pages 108 and 110 by rotating wheel means 136 or 138 in the direction which drives the traveling collars 176 and 178 or 180 and 182 toward the midpoint of the shaft 124 or 126, extends the support arms 140 and 142 or 144 and 146, and elevates the planar means 116 or 118 and calendar pages 108 or 110 with respect to the calendar base means 106. The calendar pages 108 or 110 are lowered with respect to the calendar base means 106 by rotating wheel means 136 or 138 in the direction which drives the traveling collars 176 and 178 or 180 and 182 away from the midpoint of shaft 124 or 126 (because of the reverse threading at the two ends of the shaft) and retracts the support arms 140 and 142 or 144 and 146. The adjusting means 112 and 114 provide an apparatus for keeping the two exposed calendar pages level with each other throughout a year; i.e., as the year advances and pages are turned from one side of the calendar apparatus 104 to the other the height of the stack of pages on either side of the calendar varies. The adjusting means 112 and 114 will compensate for the varying differences in heights of the stacks of calendar pages 108 and 110, keep the surface pages level, and keep the surface pages in a position accessible from the outside of the work surface 22 in the closed position 40 when the calendar apparatus 104 is used with the inclined work surface 20.

In the use and operation of the calendar apparatus 104 with the inclined work surface 20, the calendar base means is either mounted in space 58 of the support means 24 or may be a formed part of space 58. Space 58 is directly below the calendar opening 102 and the opening 102 allows access to the calendar pages 108 and 110 in the closed position 40 of the work surface 22 as illustrated in FIGS. 2 and 5.

What is claimed is:

1. A calendar apparatus, comprising:

a calendar base means for receiving and retaining calendar pages;

said calendar pages hingeably retained to said base by inverted U-shaped harps wherein said pages are retained on each side of said harps;

a separate adjusting means for each said side to adjust the height of said pages, each said adjusting means being independent of each other and unconnected to said harps.

2. A calendar apparatus, comprising:

a calendar base means for receiving and retaining calendar pages;

at least two adjusting means for adjusting the height of the facing pages on each side of the calendar, each adjusting means comprising:

planar means for supporting the calendar pages and providing a stable and comfortable writing surface below the calendar pages;

elevator means for varying the height of the planar means relative to the calendar base means, comprising:

a shaft mounted traversely to the planar means and the calendar pages, the shaft being threaded from near each end of the shaft to near the midpoint of the shaft, the threads at one end of the shaft being reverse threaded to the threads at the other end of the shaft;

retaining means for rotably retaining the ends of the shaft;

wheel means for rotating the shaft; and at least two elongated support arms, each arm having a first end hingingly connected to the planar means and a second end hingingly and threadingly connected to one of the threaded ends of the shaft, the second end of one arm being connected to the opposite end of the shaft from the second end of the other arm.

3. The apparatus of claim 2 wherein the planar means is canted.

4. The apparatus of claim 2 in which the calendar base means further comprises:

two inverted "U" post harps for retaining the calendar; and wherein the planar means includes two holes for slidingly engaging the harps of the calendar base means.

5. The apparatus of claim 4 wherein the peripheries of the holes include alignment bushings.

6. The apparatus of claim 2 wherein the wheel means is located at the end of the shaft towards the outside of the calendar base means.

7. The apparatus of claim 2 in which the wheel means further comprises: radially extending tines.

8. The apparatus of claim 2 in which the shaft further comprises:

at least two traveling collars threadingly engaging the shaft threads, each traveling collar also hingingly engaging the second end of one of the support arms.

* * * * *